US007039157B2

(12) United States Patent
Fujii et al.

(10) Patent No.: US 7,039,157 B2
(45) Date of Patent: May 2, 2006

(54) X-RAY MICROSCOPE APPARATUS

(75) Inventors: Sadao Fujii, Funabashi (JP); Mikio Muro, Noda (JP); Eiji Sato, Noda (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 13 days.

(21) Appl. No.: 10/613,082

(22) Filed: Jul. 7, 2003

(65) Prior Publication Data

US 2004/0005026 A1 Jan. 8, 2004

(51) Int. Cl.
*G21K 7/00* (2006.01)

(52) U.S. Cl. ..... 378/43

(58) Field of Classification Search ..... 378/43, 378/62

See application file for complete search history.

(56) References Cited

U.S. PATENT DOCUMENTS

| | | | | |
|---|---|---|---|---|
| 5,045,696 | A * | 9/1991 | Hirose | 378/43 |
| 5,095,243 | A * | 3/1992 | Kinoshita et al. | 313/376 |
| 5,199,057 | A * | 3/1993 | Tamura et al. | 378/43 |
| 5,533,083 | A * | 7/1996 | Nagai et al. | 378/44 |
| 5,569,916 | A * | 10/1996 | Tomie | 378/43 |
| 6,795,462 | B1 * | 9/2004 | Christiansen et al. | 372/37 |

FOREIGN PATENT DOCUMENTS

| | | | |
|---|---|---|---|
| JP | 01134300 | A * | 5/1989 |
| JP | A 1-117252 | | 5/1989 |
| JP | 02-259600 | | 10/1990 |
| JP | 03-083000 | | 4/1991 |
| JP | 03-134943 | | 6/1991 |
| JP | B2 6-40476 | | 5/1994 |
| JP | 07-167999 | | 7/1995 |
| JP | A 8-29600 | | 2/1996 |
| JP | A 8-75676 | | 3/1996 |
| JP | 08-194100 | | 7/1996 |
| JP | 09-021900 | | 1/1997 |
| JP | B2 2637482 | | 4/1997 |
| JP | 2001-023795 | | 1/2001 |
| WO | WO 200103256 | A1 * | 1/2001 |

* cited by examiner

*Primary Examiner*—Edward J. Glick
*Assistant Examiner*—Chih-Cheng Glen Kao
(74) *Attorney, Agent, or Firm*—Oliff & Berridge, PLC

(57) ABSTRACT

An X-ray microscope apparatus includes an X-ray generator, a photocathode disposed on a path of X-rays for producing electrons when irradiated with X-rays generated by the X-ray generator, an electron image enlarging device having an acceleration anode for accelerating electrons produced by the photocathode and a magnetic lens for enlarging and focusing an electron beam of electrons emitted by the photocathode, an electron beam detecting device for detecting the electron beam focused thereon by the electron image enlarging device; and an image processing device for processing an electron image formed by the electron beam detecting device. The X-ray microscope apparatus can be formed in compact construction.

12 Claims, 3 Drawing Sheets

X-RAY MICROSCOPE APPARATUS

BACKGROUND OF THE INVENTION

1. Field of the Invention

The present invention relates to an X-ray microscope apparatus and, more particularly, to an X-ray microscope apparatus capable of forming an enlarged X-ray image of a specimen held in contact condition.

2. Description of the Related Art

Some of X-ray microscopes that form a high-resolution transmission image of an object by using X-rays of short wavelengths having high penetrating power use an X-ray imaging device and the others do not. X-ray imaging devices include Fresnel zone plates, grazing incidence mirrors, etc. Since the X-ray imaging device has low converging power, the focal length of an X-ray magnification optical system is inevitably long and hence the X-ray microscope has a big overall length. Although the resolution of the most advanced zone plate system is 50 nm, the zone plate system needs a light source capable of emitting intense light, such as synchrotron radiation, because the condensing efficiency of the X-ray imaging device is low. Since it is difficult to provide an X-ray imaging device with a zooming function that enables magnification adjustment, another image enlarging device, such as an optical microscope, must be used in combination with the X-ray imaging device to specify the observation position of the object, which requires troublesome operations.

Some of the X-ray microscopes not using the X-ray imaging device use a projection enlargement method of observing a projected image formed by diverging X-rays emitted by a point light source and transmitted trough a specimen placed near the point light source, while the others use a contact imaging method of observing an enlarged X-ray image obtained by magnifying an image formed by irradiating a specimen held in contact with a photoresist plate with X-rays, and developing a latent image and enlarging by a proper optical system.

The projection enlargement method inevitably involves penumbral blurring due to the size of the X-ray source and diffraction blurring due to the specimen. Therefore, the practical resolution of the projection enlargement method is in the range of about 0.1 to 0.2 μm.

The contact imaging method does not use any X-ray enlarging optical system and hence does not cause any aberration and the image of the specimen is blurred scarcely because the specimen is held in contact with the photoresist plate. Thus, in principle, the contact imaging method is able to form easily an image of a high resolution. The resolution achievable by the contact imaging method is dependent on the particle size of the photoresist. The contact imaging method is able to form images of a high resolution of 10 nm or below when an X-ray resist of a high resolution. However, since the photoresist plate in the present state has a very low sensitivity, an X-ray source capable of emitting intense X-rays is necessary. The observation of an enlarged X-ray image needs troublesome operations for taking the photoresist plate out of a vacuum vessel, forming an X-ray image by a developing process, and enlarging the developed X-ray image by an optical microscope or the like for observation. Since the vacuum of the vacuum vessel needs to be broken in taking the photoresist plate out of the vacuum vessel, many X-ray images cannot continuously be obtained.

X-ray microscope apparatuses disclosed in JP-A Nos. 117252/1989 and 29600/1996 enlarge an X-ray image obtained by irradiating a specimen with X-rays by an X-ray imaging device to obtain an enlarged X-ray image, project the enlarged X-ray image on a photocathode to convert the X-ray image into an electron image, enlarge the electron image by the agency of magnetic lenses to obtain an enlarged electron image, project the enlarged electron image on a fluorescent screen to form an optical image on the fluorescent screen, and photograph the optical image by a camera to obtain a picture for observation. These previously disclosed X-ray microscope apparatuses using X-ray enlargement, electronic enlargement and optical enlargement do not need any developing process and any other microscope for the observation of enlarged images, and are capable of forming a large image obtained by magnifying an original image at a very high magnification in a real-time mode.

However, those known X-ray microscope apparatuses using the X-ray enlarging optical system are large and cannot be installed in a narrow place.

SUMMARY OF THE INVENTION

Accordingly, it is an object of the present invention to provide an X-ray microscope apparatus using a contact imaging method capable of forming sharp X-ray images, having a small size and easy to use.

According to the present invention, an X-ray microscope apparatus comprises; an X-ray generator; a photocathode disposed on a path of X-rays generated by the X-ray generator, the photocathode being configured to produce electrons when irradiated with X-rays generated by the X-ray generator so that an electron image of a specimen held on the photocathode is formed; an electron image enlarging device configured to enlarge the electron image of the specimen, the electron image enlarging device including an acceleration anode configured to accelerate electrons produced by the photocathode and a magnetic lens configured to enlarge and focus an electron beam of electrons emitted by the photocathode; an electron beam detecting device configured to detect an electron beam focused thereon by the electron image enlarging device; and an image processing device configured to process an electron image formed by the electron beam detecting device so as to provide a visible image.

The X-ray microscope apparatus holds a specimen on a photocathode in close contact condition, and irradiates the specimen from behind with X-rays generated by the X-ray generator to form an electron image of the specimen by X-rays penetrated the specimen on the photocathode. Then, the electron image enlarging device pulls electrons emitted by the electron image to accelerate the electrons for travel in a direction opposite a direction toward the X-ray generator, and forms an enlarged electron image on the surface of the electron beam detecting device. The image processing device processes the electron image formed on the surface of the electron beam detecting device to display a visible image.

The X-ray microscope apparatus does not use any X-ray optical system that enlarges an X-ray image formed by X-rays projected on and penetrated a specimen. Therefore, the X-ray microscope apparatus is small in construction. Since the specimen is held in close contact with the photocathode, a sharp X-ray transmission image can be formed.

The photocathode provided with a two-layer thin film consisting of a gold thin film and a film of cesium iodide or cesiumantimonide converts this X-ray image into an electron image, the electron image enlarging device provided with the magnetic lenses enhance electron currents emitted from the back surface of the photocathode and projects the same on the surface of an electron beam detecting device, such as a CCD to form a visible image. Thus, the high-resolution X-ray transmission image can be formed in a real-time mode without using troublesome processes, such as a developing process and such.

The magnification of the electron image enlarging device can continuously be varied by adjusting currents supplied to the magnetic lenses. Therefore, a minute object can precisely be located and observed by determining the position of the object using the electron image enlarging device at a low magnification and displaying a desired object at a high magnification.

The X-ray generator may be a synchrotron radiation source capable of generating synchrotron radiation. Since the synchrotron radiation source is capable of generating intense X-rays of wavelengths in a narrow wavelength range, a sufficiently sharp X-ray transmission image can be formed even if the photocathode has a low sensitivity.

The X-ray generator may be a conventional electron-beam-pumped X-ray generator that generates X-rays by accelerating electrons and makes accelerated electrons collide with a metal target or an electric-discharge-pumped X-ray generator that uses an electric discharge produced by a large-capacity capacitor.

The X-ray generator maybe a laser-plasma X-ray generator that produces a plasma by irradiating a solid or gaseous target with a fine laser beam, and uses X-rays generated by the plasma.

The X-ray microscope apparatus can be built in small construction when a laser-plasma X-ray generator is used because laser-plasma X-ray generator uses a comparatively small laser.

X-rays generated by the laser-plasma X-ray generator may be condensed by an X-ray optical device to irradiate the specimen with the condensed X-rays, which enables forming an image of satisfactory contrast even if the X-rays generated by the laser-plasma X-ray generator are weak. Naturally, intense X-rays generated by an X-ray generator having a sufficient power may be used without being condensed.

Preferably, the target is covered with a target cover made of a thin film capable of transmitting X-rays to prevent particles emitted by the target from scattering in the vacuum vessel. Preferably, a proper target is used selectively according to purposes because different images of the same specimen can be formed by using X-rays of different properties. The contamination of the vacuum vessel can be prevented by changing the metal target together with the target cover.

Preferably, the target cover is provided with an opening in its part corresponding to the passage of the laser beam to avoid attenuating the laser beam.

Preferably, a target cover formed of a material that transmits X-rays of wavelengths in the range of 2.3 to 4.4 nm generally called water window, such as silicon nitride or carbon, is used for the observation of a biological specimen.

Preferably, the X-ray microscope apparatus according to the present invention is small in construction so that it is not subject to restrictions on places for installation, is capable of being installed in a comparatively narrow place, and is utilizable in various fields. Floor space necessary for installing the X-ray microscope apparatus can be reduced by adjacently disposing the laser and the electron image enlarging device such that the laser beam emitted by the laser and the electron beam used by the electron image enlarging device are parallel.

When the X-ray microscope apparatus is formed such that the axis of the laser beam emitted by the laser and the axis of the electron beam used by the electron image enlarging device are included in a common horizontal plane, the positional adjustment of the X-ray microscope apparatus is easy in installing or reusing the X-ray microscope apparatus.

When the X-ray microscope apparatus is formed such that the axis of the laser beam emitted by the laser and the axis of the electron beam used by the electron image enlarging device are included in a common vertical plane, the X-ray microscope apparatus needs less floor space for installation.

The X-ray microscope apparatus can be formed in compact construction by disposing the laser below the electron image enlarging device, and disposing a power supply unit for supplying power to the laser and a vacuum pump below the laser, and the X-ray microscope apparatus can be installed in a small space.

The installation of the X-ray microscope apparatus with the axis of the electron beam used by the electron image enlarging device vertically extended prevents the change of the optical axis of the X-ray microscope apparatus due to the displacement of the magnetic lenses by gravity and the resultant formation of a blurred image attributable to unsatisfactory focusing due to the displacement of the focal point, and is effective in forming an image of a good image quality.

The X-ray generator may be disposed either above the electron image enlarging device to make the electron beam travel downward or below the electron image enlarging device to make the electron beam travel upward.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
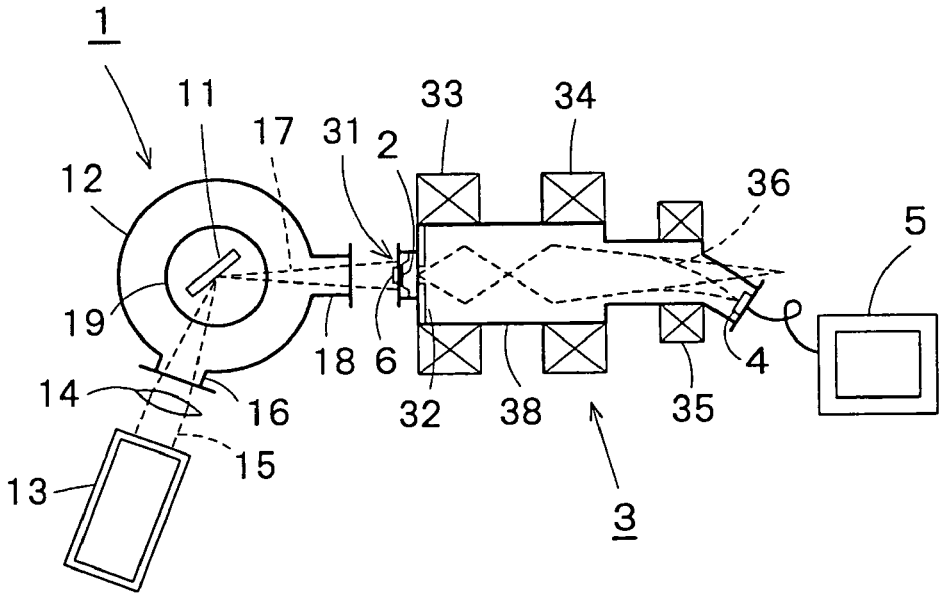
FIG. 1 is a diagrammatic sectional view of an X-ray microscope apparatus in a first embodiment according to the present invention.

Referring to FIG. 1, an X-ray microscope apparatus in a first embodiment according to the present invention includes an X-ray generator 1, a photocathode 2, an electron image enlarging device 3, an electron beam detecting device 4 and an image processing device 5.

The X-ray generator 1 includes a vacuum vessel 12 defining a vacuum chamber for holding a target 11 of a metal therein, a laser 13, and a condenser lens 14. The condenser lens condenses a laser beam 15 emitted by the laser 13. The condensed laser beam 15 travels through an inlet nozzle 16 attached to the vacuum vessel 12 onto the vacuum chamber and falls on a surface of the target 11. The metal forming the target 11 is heated rapidly into a plasma and thereby X-rays 17 are generated.

The target 11 may be surrounded by a target cover 19 to prevent metal particles from scattering and adhering to the inner surface of the vacuum vessel 12. The target cover 19 must be formed of a material transparent to X-rays, such as a beryllium film or a plastic film. Preferably, the target cover 19 is provided with an opening in a part corresponding to the passage of the laser beam 15 to avoid intercepting the laser beam 15.

The X-rays 17 emitted by the target 11 are radiated outside through a radiation nozzle 18 and falls on a receiving surface of the photocathode 2. A specimen 6 is attached to the photocathode 2 in close contact with the receiving surface thereof. An image having shades corresponding to the specimen 6 is formed on the photocathode 2. The receiving surface of the photocathode 2 is formed of a photoelectric film capable of photoelectric conversion, such as a two-layer thin film consisting of a metal thin film and a film of cesium iodide or cesium antimonide. The photocathode 2 is attached to the inner surface of an entrance window 31, which is covered with an X-ray transmitting film, of the electron image enlarging device 3. Parts of the photocathode 2 irradiated with incident X-rays emit amounts of photoelectrons according to the intensities of the incident X-rays fallen thereon, respectively, to form an electron image corresponding to the X-ray image.

The electron image enlarging device 3 has an X-ray entrance window 31, an acceleration anode 32, and magnetic lenses 33, 34 and 35. The acceleration anode 32 accelerates the photoelectrons emitted from the inner surface of the photocathode 2 toward the electron image enlarging device 3. The first magnetic lens 33 and the second magnetic lens 34 enlarge and focus a photoelectron image to form am enlarged photoelectron image on the entrance surface of the electron beam detecting device 4 disposed at a predetermined position.

The first magnetic lens 33 serves as an objective lens for magnifying an electron image formed by the photocathode 2, and the second magnetic lens 34 serves as a projection lens for the further enlargement of a real electron image formed by the objective lens and forming the enlarged electron image on the entrance surface of the electron beam detecting device 4. The magnification of the first magnetic lens 33 and the second magnetic lens 34 can be adjusted by adjusting the respective intensities of currents supplied to the first magnetic lens 33 and the second magnetic lens 34 without changing focal length corresponding to the distance between the photocathode 2 and the electron beam detecting device 4.

X-rays fallen on the electron beam detecting device 4 produce noise in the electron image formed by the electron beam detecting device 4. Since X-rays travel rectilinearly and are difficult to deflect, the electron beam detecting device 4 is disposed at a position apart from the axis of the electron image enlarging device 3, and the third magnetic lens 35 interposed between the second magnetic lens 34 and the electron beam detecting device 4 deflects the electron beam to focus the electron beam on the entrance surface of the electron beam detecting device 4. Since X-rays are not deflected by magnetic lenses, X-rays do not fall on the electron beam detecting device 4 and thereby noise in the electron image can effectively be reduced.

The electron image enlarging device 34 is provided with a vacuum vessel 38, through which the electron beam 36 travels.

The electron beam detecting device 4 is a functional device for visualizing the electron beam. For example, the electron beam detecting device 4 may comprise a microchannel plate, and a fluorescent screen disposed behind the microchannel plate to display a visible image for observation and may further comprise an optical system including a relay lens and disposed behind the fluorescent screen, and a CCD camera to produce electric signals.

Electric image signals produced by the electron beam detecting device 4 are sent to the image processing device 5. The image processing device 5 processes the electric image signals properly to display a proper image meeting the object of measurement on the screen of a monitor.

The conventional X-ray microscope apparatus needs to use an optical microscope to locate a specimen in determining a part, to be observed, of the specimen, which is troublesome and takes much time for adjustment. The present X-ray microscope apparatus is easily able to determine a part, to be observed, of a specimen and to display the part in an enlarged image by the agency of the zooming function of the magnetic lenses.

The conventional X-ray microscope apparatus attaches a specimen to a film in close contact with the film, prints an X-ray transmission image of the specimen on the film, forms a visible image by subjecting the film to developing and fixing processes, and enlarges the visible image by an optical microscope for observation. Therefore, the X-ray transmission image can be formed without aberration, and the visible image can be formed in a high resolution. However, the conventional X-ray microscope apparatus thus takes much time for observation. The X-ray microscope apparatus of the present invention is able to achieve observation without requiring much time and is easily able to achieve the observation of an enlarged, high-resolution image.

It goes without saying that the X-ray microscope apparatus may employ a synchrotron radiation source, an electron-beam-pumped X-ray generator or an electric-discharge-pumped X-ray generator as the X-ray generator.

Figure 2:
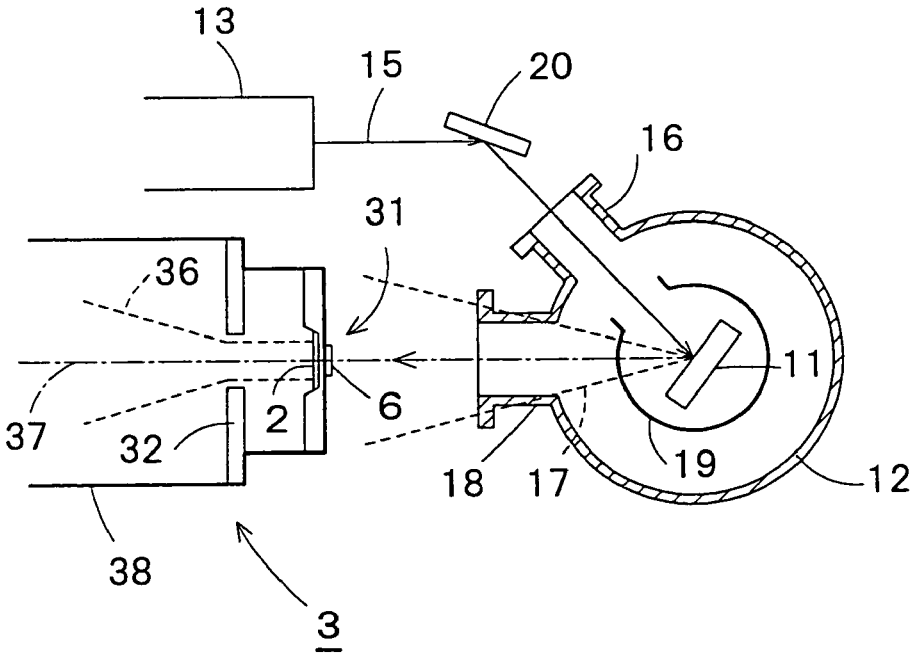
FIG. 2 is an enlarged diagrammatic sectional view of an X-ray generator included in an X-ray microscope apparatus in a second embodiment according to the present invention.
Figure 3:
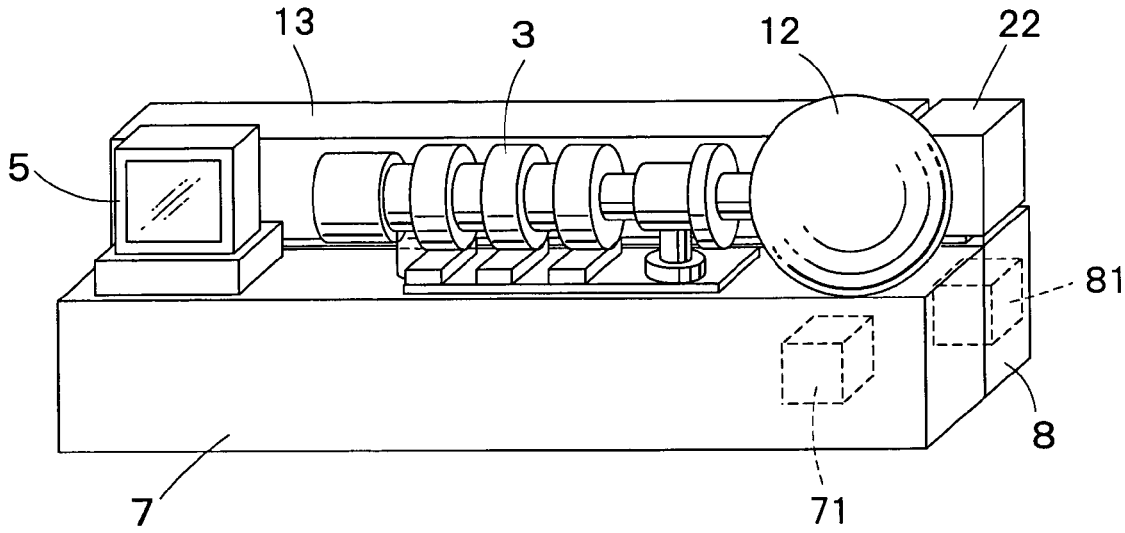
FIG. 3 is a perspective view of the X-ray microscope apparatus in the second embodiment.
Figure 4:
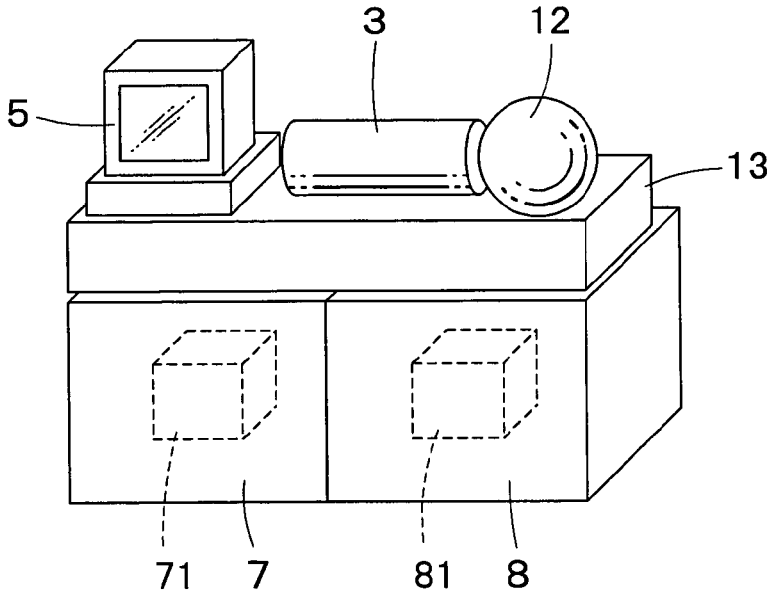
FIG. 4 is a perspective view of an X-ray microscope apparatus in a first modification of the X-ray microscope apparatus in the second embodiment.
Figure 5:
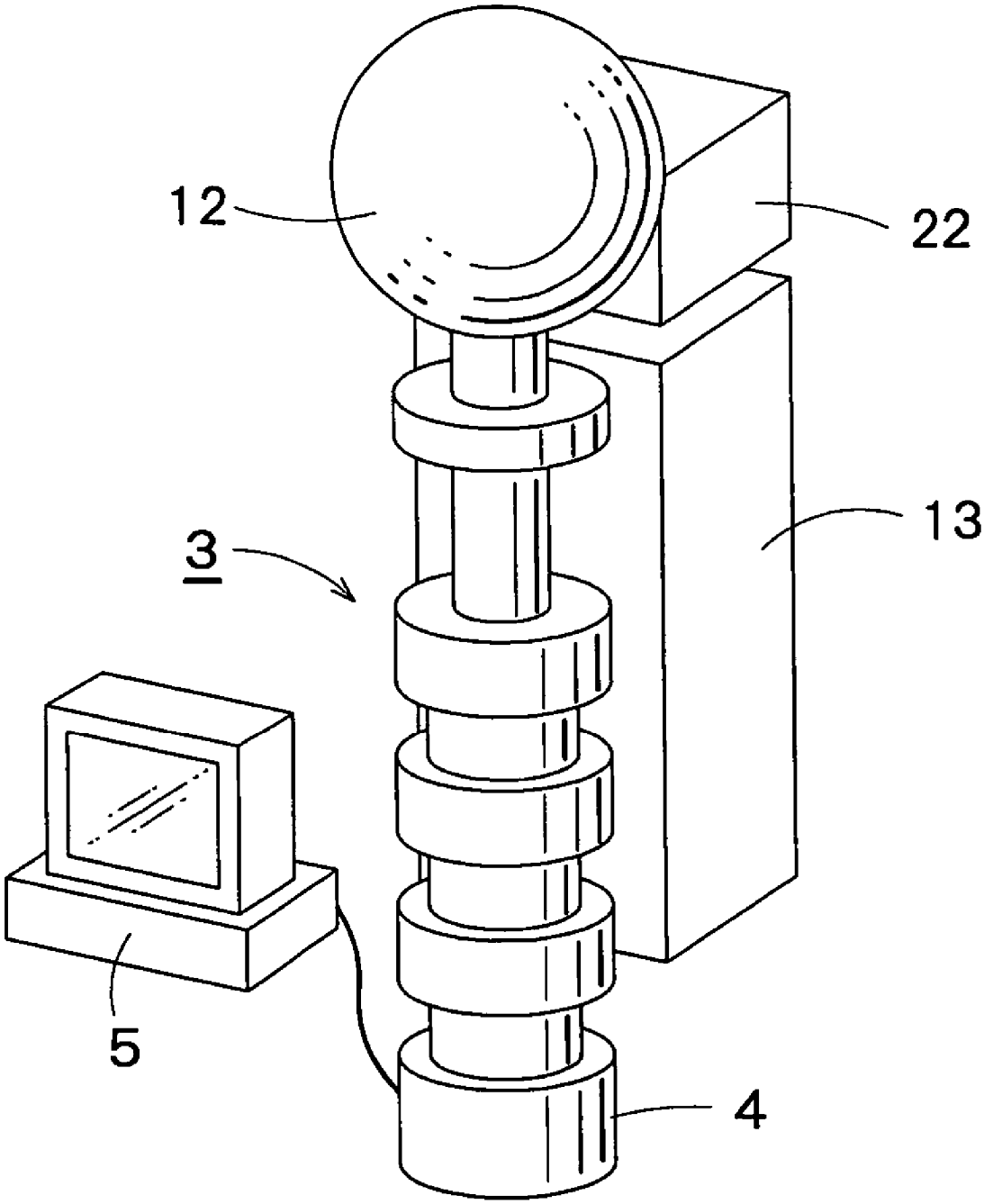
FIG. 5 is a perspective view of an X-ray microscope apparatus in a second modification of the X-ray microscope apparatus in the second embodiment.

FIG. 2 is an enlarged diagrammatic sectional view of an X-ray generator included in an X-ray microscope apparatus in a second embodiment according to the present invention. FIG. 3 is a perspective view of the X-ray microscope apparatus in the second embodiment. FIG. 4 is a perspective view of an X-ray microscope apparatus in a first modification of the X-ray microscope apparatus in the second embodiment. FIG. 5 is a perspective view of an X-ray microscope apparatus in a second modification of the X-ray microscope apparatus in the second embodiment. The X-ray microscope apparatus in the second embodiment differs from the X-ray microscope apparatus in the first embodiment only in that a laser and an electron image enlarging device are disposed such that the axis of a laser beam emitted by the laser and the axis of an electron beam in the electron image enlarging device 3 are parallel, and hence parts of the second embodiment like or corresponding to those of the first embodiment are denoted by the same reference characters and the description thereof will be omitted to avoid duplication.

As shown in FIG. 2, in the X-ray microscope apparatus according to the second embodiment, the laser 13 and the electron image enlarging device 3 are disposed such that the axis of a laser beam 15 emitted by the laser 13 and the axis 37 of an electron beam 36 in the electron image enlarging device 3 are parallel. An incident angle adjusting mirror 20 is disposed between the laser 13 and an entrance nozzle 16 formed on the vacuum vessel 12. The incident angle adjusting mirror 20 reflects the laser beam 15 emitted by the laser 13 toward the metal target 11.

Even though the laser 13 and the electron image enlarging device 3 are disposed such that the axis of the laser beam 15 emitted by the laser 13 and the axis 37 of the electron beam 36 in the electron image enlarging device 3 are parallel, a sharp X-ray image can be formed by adjusting the position of the incident angle adjusting mirror so that the laser beam 15 falls at a predetermined incident angle on the metal target 11, because a specimen 6 attached to a photocathode 2 in close contact with the entrance surface of the photocathode 2 can be irradiated with X-rays of an intensity sufficient for observation.

An electron image formed on a surface, on the side of the electron image enlarging device 3, of the photocathode 2 is pulled and accelerated by an acceleration anode 32 and is enlarged by the agency of an electron lens, thereby, an image is formed on an imaging surface of an electron beam detecting device 4.

Since the laser 13 and the electron image enlarging device 3, which are long components of the X-ray microscope apparatus, are disposed side by side, the X-ray microscope apparatus can be formed in small construction having a comparatively short length, so that the X-ray microscope apparatus requires a comparatively small area for installation. Thus, restrictions on a place for the installation of the X-ray microscope apparatus are reduced, and the X-ray microscope apparatus can simply be installed in a small laboratory. Thus, the present invention succeeded in further facilitating using an X-ray microscope apparatus of a contact imaging system. In the X-ray microscope apparatus in the second embodiment, the specimen can be disposed at a distance of 100 mm or below from the X-ray generator 13.

In the X-ray microscope apparatus shown in FIG. 3, the laser 13 and the electron image enlarging device 3 are disposed such that the axis of the laser beam 15 emitted by the laser 13 and the axis of the electron beam 36 in the electron image enlarging device 3 are parallel and are included in a common horizontal plane.

A first frame 7 containing an evacuating unit 71, and a second frame 8 containing a power supply unit 81 for supplying power to the laser 13 are arranged side by side. The vacuum vessel 12 holding the metal target 11, the electron image enlarging device 3 including the electron beam detecting device 4, and the image processing device 5 are mounted on the first frame 7. The laser 13, and an optical box 22 containing an optical system including the incident angle adjusting mirror 20 are mounted on the second frame 8.

Thus, the components of the X-ray microscope apparatus are assembled in compact, three-dimensional construction and hence the X-ray microscope apparatus can easily be installed in a narrow place. The arrangement of the laser 13 and the electron image enlarging device 3 such that the axis of the laser beam 15 and the axis 37 of the electron beam 36 are parallel and are included in a common horizontal plane facilitates the alignment of the components of the X-ray microscope apparatus.

FIG. 4 shows an X-ray microscope apparatus in a first modification of the X-ray microscope apparatus in the second embodiment. In the X-ray microscope apparatus shown in FIG. 4, a laser 13 and an electron image enlarging device 3 are disposed such that the axis of a laser beam emitted by the laser 13 and the axis of an electron beam in the electron image enlarging device 3 are parallel and are included in a common vertical plane.

A first frame 7 containing an evacuating unit 71, and a second frame 8 containing a power supply unit 81 for supplying power to the laser 13 are arranged longitudinally. The laser 3 and an incident angle adjusting mirror 20 are placed on the frames 7 and 8. A vacuum vessel 12 included in an X-ray generator 1, the electron image enlarging device 3 and an image processing device 5 are mounted on the laser 13.

Since the components of the X-ray microscope apparatus are thus stacked, the X-ray microscope apparatus occupies a small floor space and leaves a wide floor space unoccupied for other uses.

FIG. 5 shows an X-ray microscope apparatus in a second modification of the X-ray microscope apparatus in the second embodiment. In the X-ray microscope apparatus shown in FIG. 5, an electron image enlarging device 3 is set in a vertical position. A laser 13 and an optical box 22 containing an optical system are stacked. A vacuum vessel 12 holding a metal target, an electron image enlarging device 3 and an electron beam detecting device 4 are stacked in front of the laser 13 and the optical box 22. Image signals provided by the electron beam detecting device 4 are transmitted through a cable to an image processing device 5, and images are displayed on the screen of a monitor.

If the electron image enlarging device 3 is set in a horizontal position, the magnetic lenses disposed at the most effective positions with respect to the axis of the electron beam may be displaced perpendicularly to the axis of the electron beam due to gravity and, consequently, the axis of the electron beam may be deviated from the optical axis of the electron image enlarging device 3. As a result, when the magnetic lenses are energized for electron image enlargement, the electron beam may not accurately be focused.

Even if the magnetic lenses of the electron image enlarging device 3, which is set in a vertical position, of the X-ray microscope apparatus shown in FIG. 5 are displaced vertically by gravity, the effect of the vertical displacement of the magnetic lenses on the position of the axis of the electron beam is insignificant and does not affect significantly to the enlargement and focusing of the electron beam.

Thus, the setting of the electron image enlarging device 3 in a vertical position is effective in preventing the deterioration of the performance of the X-ray microscope apparatus.

Needless to say, the vacuum vessel 12 may be disposed below the electron image enlarging device 3 to emit the electron beam upward, and the electron beam may be focused on the detecting surface of the electron beam detecting device 4 disposed above the electron image enlarging device 3.

As apparent from the foregoing description, the X-ray microscope apparatus according to the present invention forms an X-ray image of a specimen held in close contact with the photocathode, enlarges an electron image directly by the electron image enlarging device and displays an enlarged electron image. Thus, the X-ray microscope apparatus enables the simple observation of an X-ray image in a real time mode without requiring troublesome operations.

Since the X-ray microscope apparatus of the present invention does not include a long X-ray optical system, the X-ray microscope apparatus is small and compact in construction and is not particular about places for installation. The arrangement of the laser and the electron image enlarging device in which the axis of the laser beam and the axis of the electron beam are parallel enables the X-ray microscope apparatus to be formed in further compact construction and to be utilized in various fields.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. An X-ray microscope apparatus comprising;

an X-ray generator including a laser and capable of generating X-rays by irradiating a target with a laser beam;

a photocathode disposed on a path of X-rays generated by the X-ray generator, the photocathode being configured to produce electrons when irradiated with X-rays generated by the X-ray generator so that an electron image of a specimen held on the photocathode is formed;

an electron image enlarging device configured to enlarge the electron image of the specimen, the electron image enlarging device including an acceleration anode configured to accelerate electrons produced by the photocathode and a magnetic lens configured to enlarge and focus an electron beam of electrons emitted by the photocathode, the magnetic lens including a first magnetic lens configured to act as an objective lens for enlarging and focusing the beam and a second magnetic lens configured to act as a projection lens for enlarging and focusing the beam;

an electron beam detecting device configured to detect an electron beam focused thereon by the electron image enlarging device; and an image processing device configured to process an electron image formed by the electron beam detecting device so as to provide a visible image.

2. The X-ray microscope apparatus according to claim 1, wherein X-rays generated by the X-ray generator is applied directly to the photocathode.

3. The X-ray microscope apparatus according to claim 1, wherein the X-ray generator is provided with an X-ray condensing device capable of condensing X-rays generated by the X-ray generator so that condensed X-rays are applied to the photocathode.

4. The X-ray microscope apparatus according to claim 1, wherein the target is covered with a protective target cover made of a thin film capable of transmitting X-rays.

5. The X-ray microscope apparatus according to claim 4, wherein the protective target cover is formed of a material that transmits X-rays of wavelengths in a range of 2.3 to 4.4 nm effectively.

6. The X-ray microscope apparatus according to claim 1, wherein the laser and the electron image enlarging device are disposed such that an axis of the laser beam emitted by the laser and an axis of the electron beam used by the electron image enlarging device are parallel.

7. The X-ray microscope apparatus according to claim 6, wherein the axis of the laser beam emitted by the laser and the axis of the electron beam used by the electron image enlarging device are included in a common horizontal plane.

8. The X-ray microscope apparatus according to claim 6, wherein the axis of the laser beam emitted by the laser and the axis of the electron beam used by the electron image enlarging device are included in a common vertical plane.

9. The X-ray microscope apparatus according to claim 8, wherein the laser is disposed below the electron image enlarging device, and a power supply unit for supplying power to the laser and an evacuating unit for evacuating the X-ray generator are disposed below the laser.

10. The X-ray microscope apparatus according to claim 1, wherein the electron image enlarging device is set such that an axis of the electron beam is vertical.

11. The X-ray microscope apparatus according to claim 10, wherein the X-ray generator is disposed above the electron image enlarging device.

12. The X-ray microscope apparatus according to claims 10, wherein the X-ray generator is disposed below the electron image enlarging device.

* * * * *